US008375742B2

(12) United States Patent
Wang

(10) Patent No.: US 8,375,742 B2
(45) Date of Patent: Feb. 19, 2013

(54) RELIQUIFIER AND RECONDENSER WITH VACUUM INSULATED SLEEVE AND LIQUID TRANSFER TUBE

(75) Inventor: Chao Wang, Manlius, NY (US)

(73) Assignee: Cryomech, Inc., Syracuse, NY (US)

( * ) Notice: Subject to any disclaimer, the term of this patent is extended or adjusted under 35 U.S.C. 154(b) by 599 days.

(21) Appl. No.: 12/264,312

(22) Filed: Nov. 4, 2008

(65) Prior Publication Data

US 2009/0049863 A1 Feb. 26, 2009

Related U.S. Application Data

(63) Continuation-in-part of application No. 11/842,420, filed on Aug. 21, 2007, now abandoned.

(51) Int. Cl.
*F25J 1/00* (2006.01)
*F25B 9/00* (2006.01)

(52) U.S. Cl. ..... 62/608; 62/6; 62/606; 62/616

(58) Field of Classification Search ..... 62/6, 606, 62/608

See application file for complete search history.

(56) References Cited

U.S. PATENT DOCUMENTS

| | | | | |
|---|---|---|---|---|
| 4,796,433 | A * | 1/1989 | Bartlett | 62/47.1 |
| 5,163,297 | A | 11/1992 | Yani et al. | |
| 5,782,095 | A * | 7/1998 | Chen | 62/47.1 |
| 5,918,470 | A * | 7/1999 | Xu et al. | 62/51.1 |
| 6,959,554 | B1 * | 11/2005 | Shirron et al. | 62/3.1 |
| 6,990,818 | B2 * | 1/2006 | Hofmann | 62/6 |
| 7,191,601 | B2 * | 3/2007 | Atrey | 62/6 |
| 7,272,937 | B2 * | 9/2007 | Mita et al. | 62/6 |
| 7,350,363 | B2 * | 4/2008 | Stautner et al. | 62/6 |
| 2002/0002830 | A1 | 1/2002 | Strobel et al. | |
| 2006/0021355 | A1 | 2/2006 | Boesel et al. | |
| 2006/0086101 | A1 * | 4/2006 | Miki | 62/48.2 |
| 2006/0260327 | A1 * | 11/2006 | Kanamori et al. | 62/6 |

OTHER PUBLICATIONS

Sumitomo Model HRT-K300 Liquid Helium Recondenser—web page from Janis Research Co. Inc. http://www.janis.com/news0202.html, dated Feb. 2002.

* cited by examiner

*Primary Examiner* — Marc Norman
*Assistant Examiner* — Filip Zec
(74) *Attorney, Agent, or Firm* — Brown & Michaels, PC

(57) ABSTRACT

A reliquifier using a cryocooler in which an insulated sleeve surrounds a portion of the cold head, a first stage cooling station, and a second stage cooling station, including a condenser. Gas is conveyed from a cryostat to the insulated sleeve, where it is liquefied as it passes over the cold head. An end of the insulated sleeve is connected to a liquid transfer tube for conveying condensed fluid back to the cryostat.

8 Claims, 7 Drawing Sheets

RELIQUIFIER AND RECONDENSER WITH VACUUM INSULATED SLEEVE AND LIQUID TRANSFER TUBE

REFERENCE TO RELATED APPLICATIONS

This is a continuation-in-part of co-pending parent patent application Ser. No. 11/842/420, entitled "Reliquifier", filed Aug. 21, 2007. The aforementioned application is hereby incorporated herein by reference.

FIELD OF THE INVENTION

The invention pertains to the field of gas liquefaction, re-liquefaction and re-condensation with a pulse tube cryocooler. More particularly, the invention pertains to a small scale helium liquifer, reliquifier and recondenser.

DESCRIPTION OF RELATED ART

With growing demand for helium worldwide and increased pressure on suppliers resulting in greatly increased prices, it is becoming evident that the world's helium supply is finite and irreplaceable. This invention relates to a small scale helium liquefier or re-liquefier using a pulse tube cryocooler. This invention can help laboratories and industries to recycle helium and produce liquid helium.

Typical closed-cycle regenerative cryogenic refrigerators (cryocoolers) include the Stirling, Gifford-McMahon and pulse tube types, all of which provide cooling through the alternating compression and expansion of a working fluid, with a consequent reduction of its temperature. Stirling and Gifford-McMahon cryocoolers use displacers to move a working fluid (usually helium) through their regenerators, exhaust the heat in the return gas to the compressor package. The noise and vibration induced by the displacer creates problems, and the wear of the seals on the displacer require periodic maintenance and replacement.

Pulse tube cryocoolers, which do not use a mechanical displacer, are a known alternative to the Stirling and Gifford-McMahon types. A pulse tube is essentially an adiabatic space wherein the temperature of the working fluid is stratified, such that one end of the tube is warmer than the other. A pulse tube refrigerator operates by cyclically compressing and expanding a working fluid in conjunction with its movement through heat exchangers. Heat is removed from the system upon the expansion of the working fluid in the gas phase. These result in high reliability, long lifetime and low vibration when compared to Stirling and GM cryocoolers.

A cryogen stored in cryostats or dewars (e.g. helium) is expensive, and no matter how efficient the cryostat or dewar is, the cryogen liquid will boil. Therefore some cryocoolers are used as reliquifiers to turn boiled cryogen vapor back into the liquid state.

In a prior art reliquifier, as shown in prior art FIG. 1, the cold head 6 of a GM cryocooler resides in a vacuum chamber 2. The cold head 6 is connected to a compressor through lines 7. Vapor 11 from the boiled helium in the cryostat or dewar 1 flows into a heat exchanger 8 thermally attached to the first stage cooling station 5. From the heat exchanger 8, the cooled vapor flows to condenser 9 where it is condensed. The condenser 9 is thermally mounted on the second stage cooling station 12. The condensed liquid drips from the fins of the condenser 9 into the liquid transfer tube 10 leading back into the cryostat or dewar 1. The prior art reliquifier only uses the first and second stage heat exchangers of the cooler to actually reliquify the cryogen vapor, which is not efficient.

SUMMARY OF THE INVENTION

A reliquifier using a cryocooler in which an insulated sleeve surrounds a portion of the cold head including the cooling stations for the first and (if present) second stages. A condenser thermally mounts to the coldest cooling station. Gas is conveyed from a cryostat to the insulated sleeve, where it is liquefied as it passes over the cryocooler cold head. An end of the insulated sleeve is connected to a liquid transfer tube for conveying condensed fluid back to the cryostat. In one embodiment, the reliquifier can also serve as a recondenser.

DETAILED DESCRIPTION OF THE INVENTION

Figure 1:
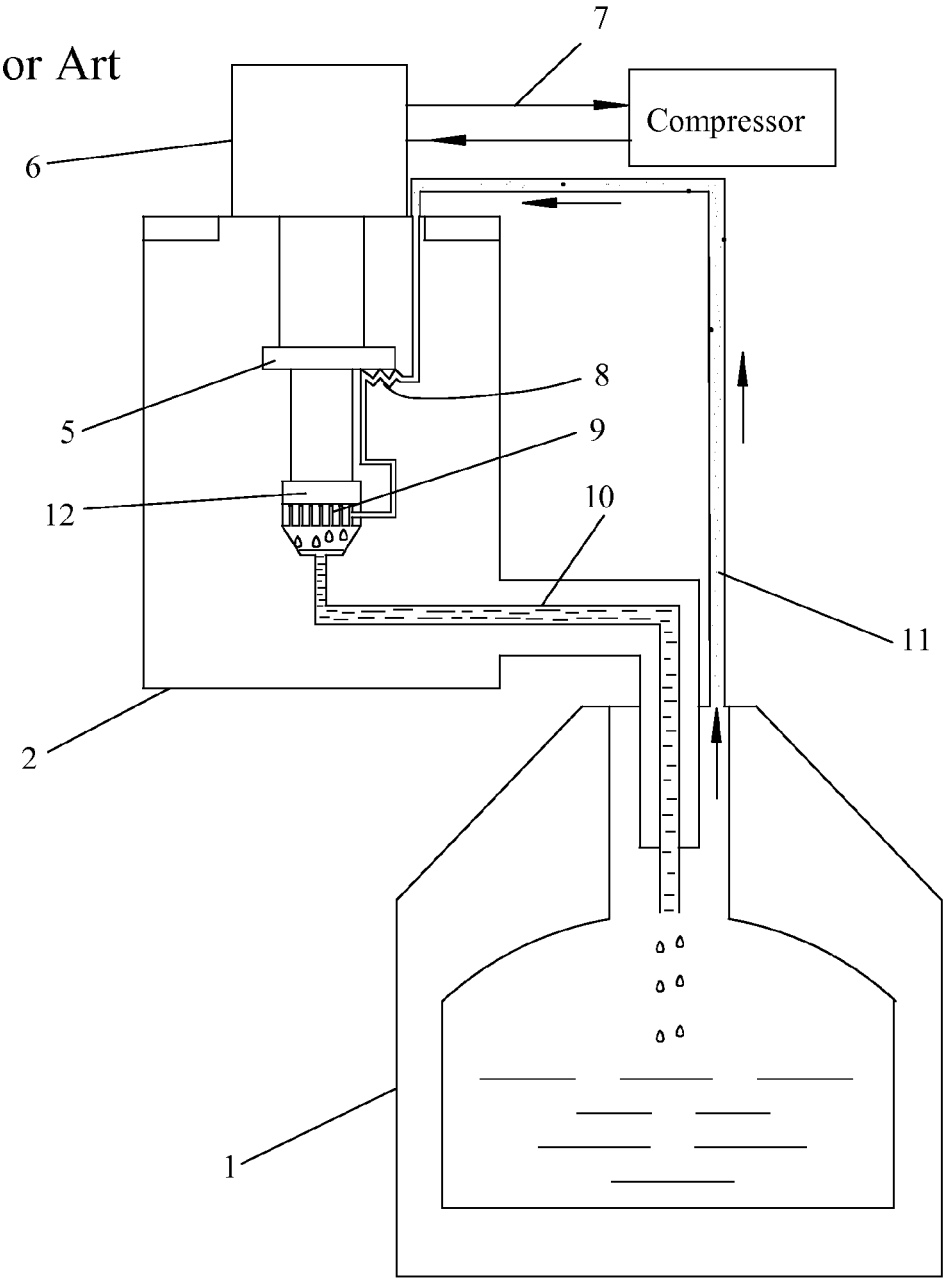
Fig. 1 Prior Art
FIG. 1 shows a prior art figure of a prior art reliquifier.
Figure 2:
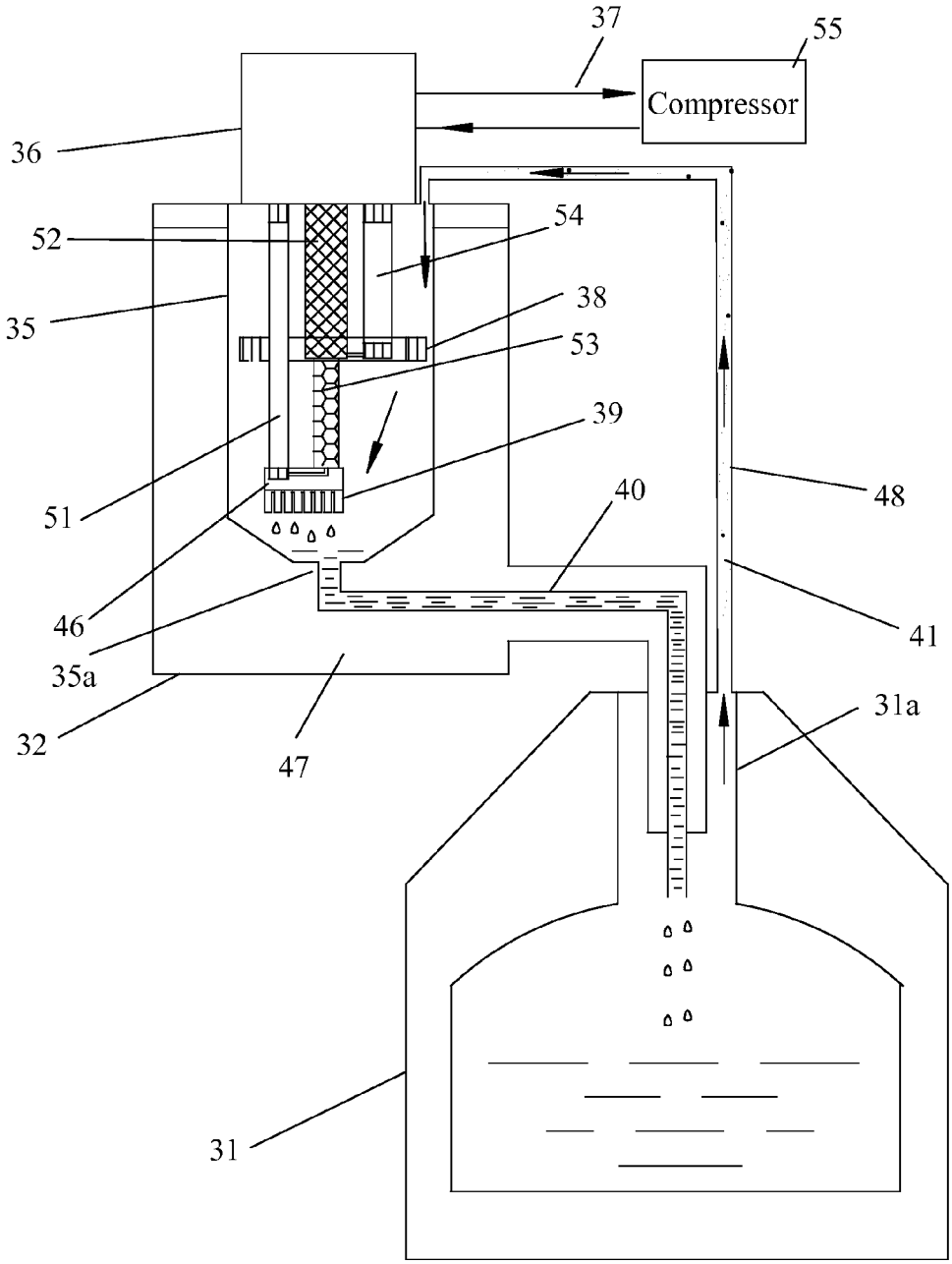
FIG. 2 shows a schematic of a reliquifier using a pulse tube cryocooler of the present invention.

FIG. 2 shows a reliquifier using a two stage pulse tube cryocooler of the present invention. A portion of the cold head 36 is present within a vacuum insulated sleeve 35 that has an end 35*a* in fluid communication with a liquid transfer tube 40 leading back to the dewar or cryostat 31. Therefore, the cold head 36 has a hot end outside and a cold end within the vacuum insulated sleeve 35. A vacuum space 47 is present between the vacuum insulated sleeve 65 and the vacuum housing 32.

The cold head includes a first stage cooling station 38 and a second stage cooling station 46. The first stage cooling station 38 has a temperature which is higher than a temperature of the second stage cooling station 46. The second stage cooling station 46 is mounted to a condenser 39. Heat from the first stage cooling station 38 is removed by the first pulse tube 54 and the first regenerator 52. Heat from the second stage cooling station 46 is removed by the second pulse tube 51 and the second regenerator 53. A compressor 55 is connected to the cold head 36 through high and low pressure lines 37 for powering the cold head.

Liquid cryogen, usually helium, stored within cryostat or dewar 31 boils off due to heat entering the inside of the cryostat 31 from the ambient atmosphere. The vapor 41 of the cryogen flows through a tube 48 connecting the cryostat 31 to the vacuum insulated sleeve 35 including a portion of the cold head 36. As it passes through the sleeve 35 and the cold head, the vapor 41 is first pre-cooled by the tubes of the first stage regenerator 52, first stage pulse tube 54 and second stage pulse tube 51. Then it is pre-cooled by the first stage cooling station 38. After that it is further pre-cooled by the tubes of the second stage regenerator 53 and second stage pulse tube 51. It finally condenses into liquid on the fins of the condenser 39. From the condenser 39, the condensed liquid drips into the bottom end 35*a* of the vacuum insulated sleeve 35 and flows back to the cryostat 31 through the liquid transfer tube 40. Due to the condensation, low gas pressure is generated around the condenser 39, causing vapor to flow from the cryostat 31 to the sleeve 35.

By having a portion of the cold head 36 reside within the vacuum insulated sleeve 35, within the cryogen vapor environment, more efficient precooling of the vapor is ensured prior to reliquifying.

Figure 3:
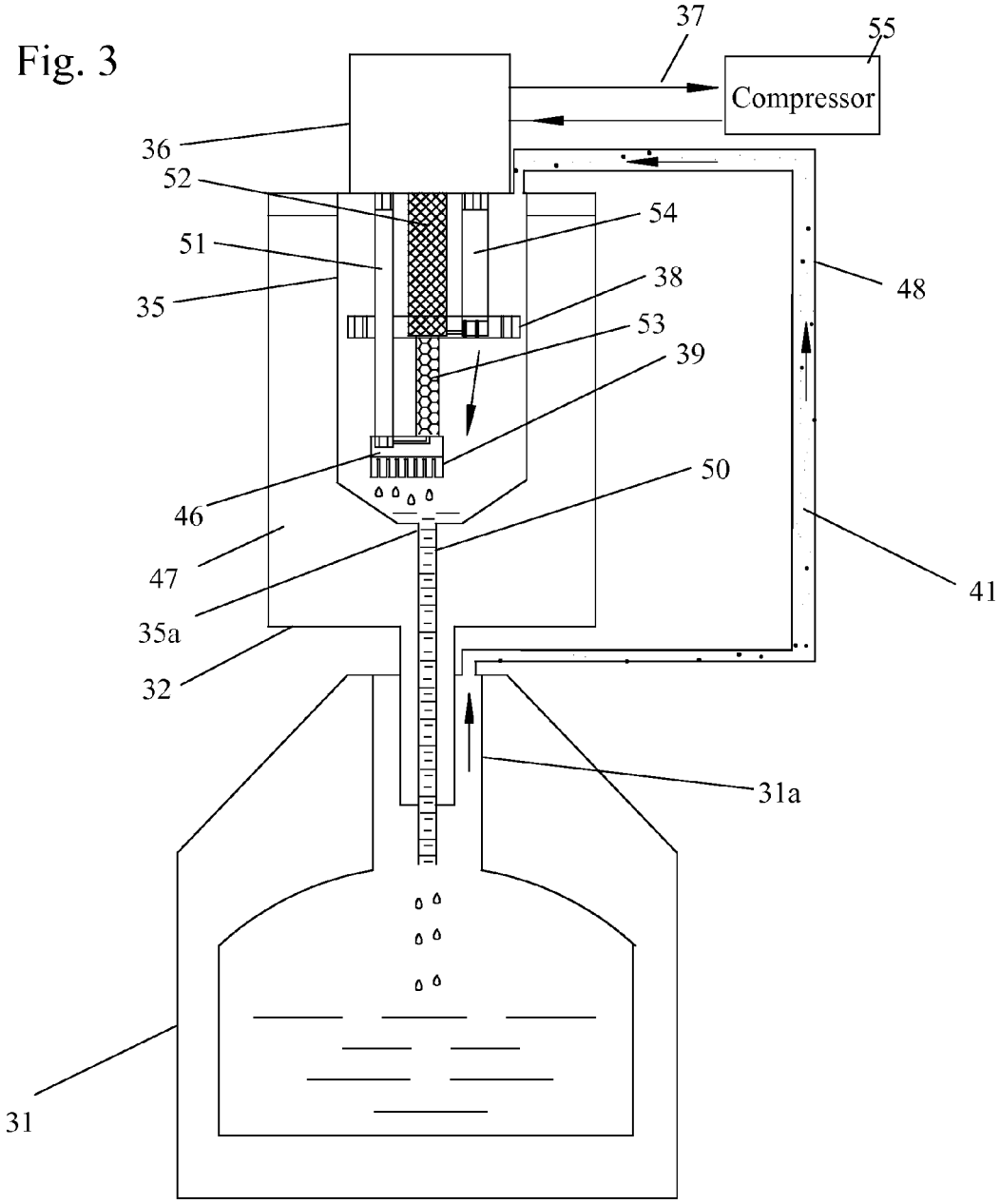
FIG. 3 shows a schematic of the reliquifier using a pulse tube cryocooler of the present invention with a straight transfer tube.

While the liquid transfer tube 40 is shown in FIG. 2 as having turns prior to reaching the neck of the cryostat, alternatively as shown in FIG. 3, the liquid transfer tube 50 may be straight between the end 35*a* of the vacuum insulated sleeve 35 and the neck 31*a* of the cryostat 31.

Figure 4:
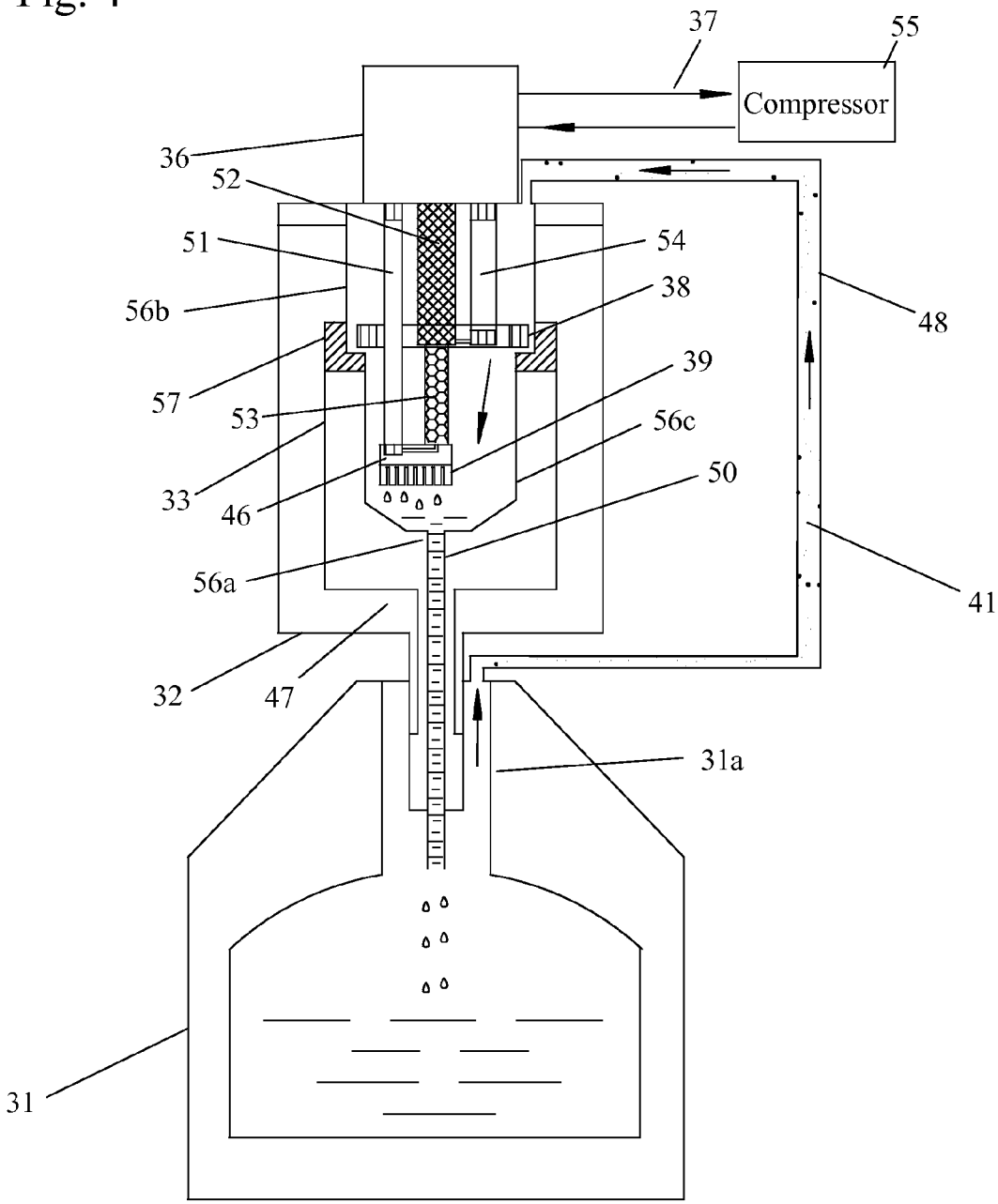
FIG. 4 shows a schematic of the reliquifier using a pulse tube cryocooler of the present invention with the sleeve separated into two parts.

FIG. 4 shows another embodiment in which the insulated vacuum sleeve 56 is separated into two portions 56*b* and 56*c* by the heat transfer ring 57. In this embodiment good contact between the heat transfer ring 57 and the first stage cooling station 38 is present. A radiation shield 33 is connected to the heat transfer ring 57 and surrounds the second portion 56*c* of the vacuum insulated sleeve 56 and the liquid transfer tube 50.

Figure 5:
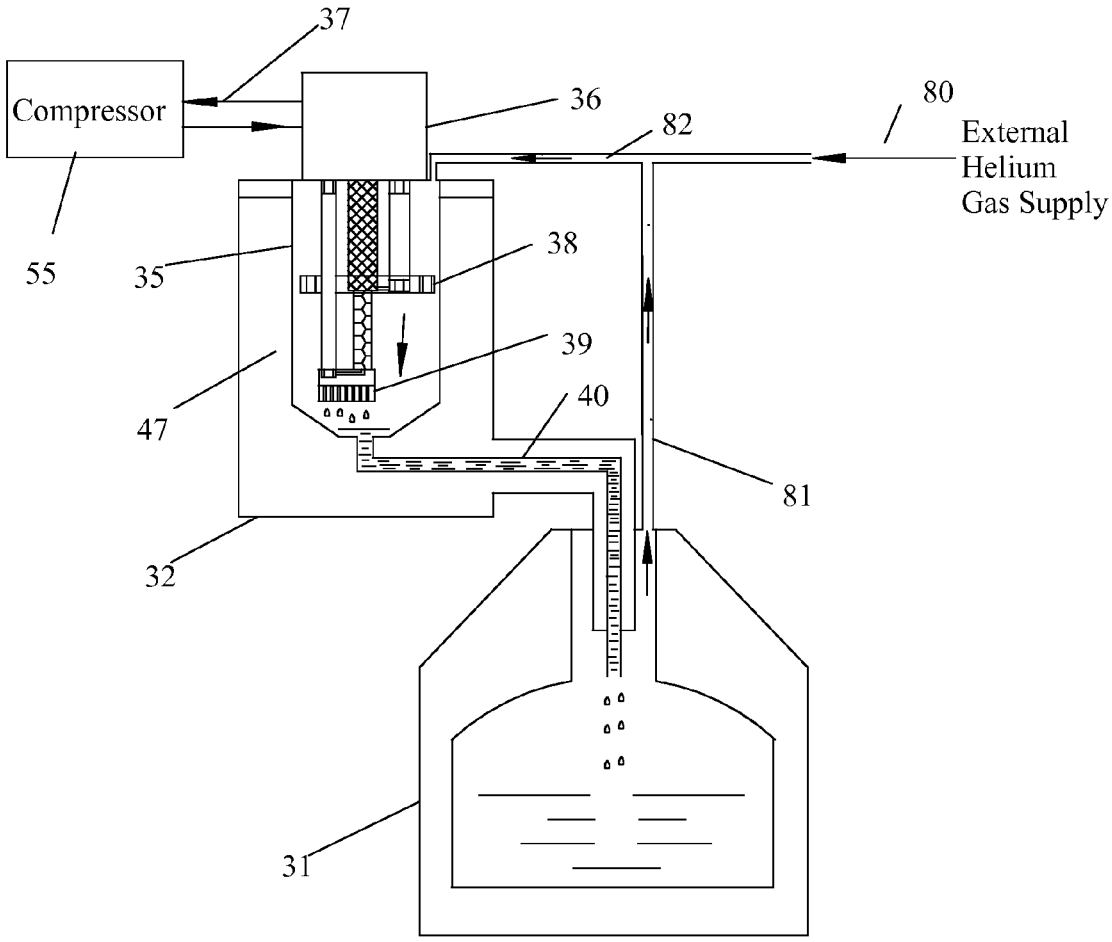
FIG. 5 shows a schematic of the reliquifier using a pulse tube cryocooler of the present invention with external helium gas supply.

FIG. 5 shows another alternative embodiment of the invention in which the reliquifier also works as a liquefier. In addition to the boiled-off cryogen in the tube 81 from the cryostat 31, additional cryogen to be liquefied is supplied from an external helium supply 80, so that the input tube 82 to the reliquifier contains a mix of boiled off and fresh cryogen. In other respects, the embodiment of FIG. 5 is similar to the embodiment of FIG. 2.

Figure 6:
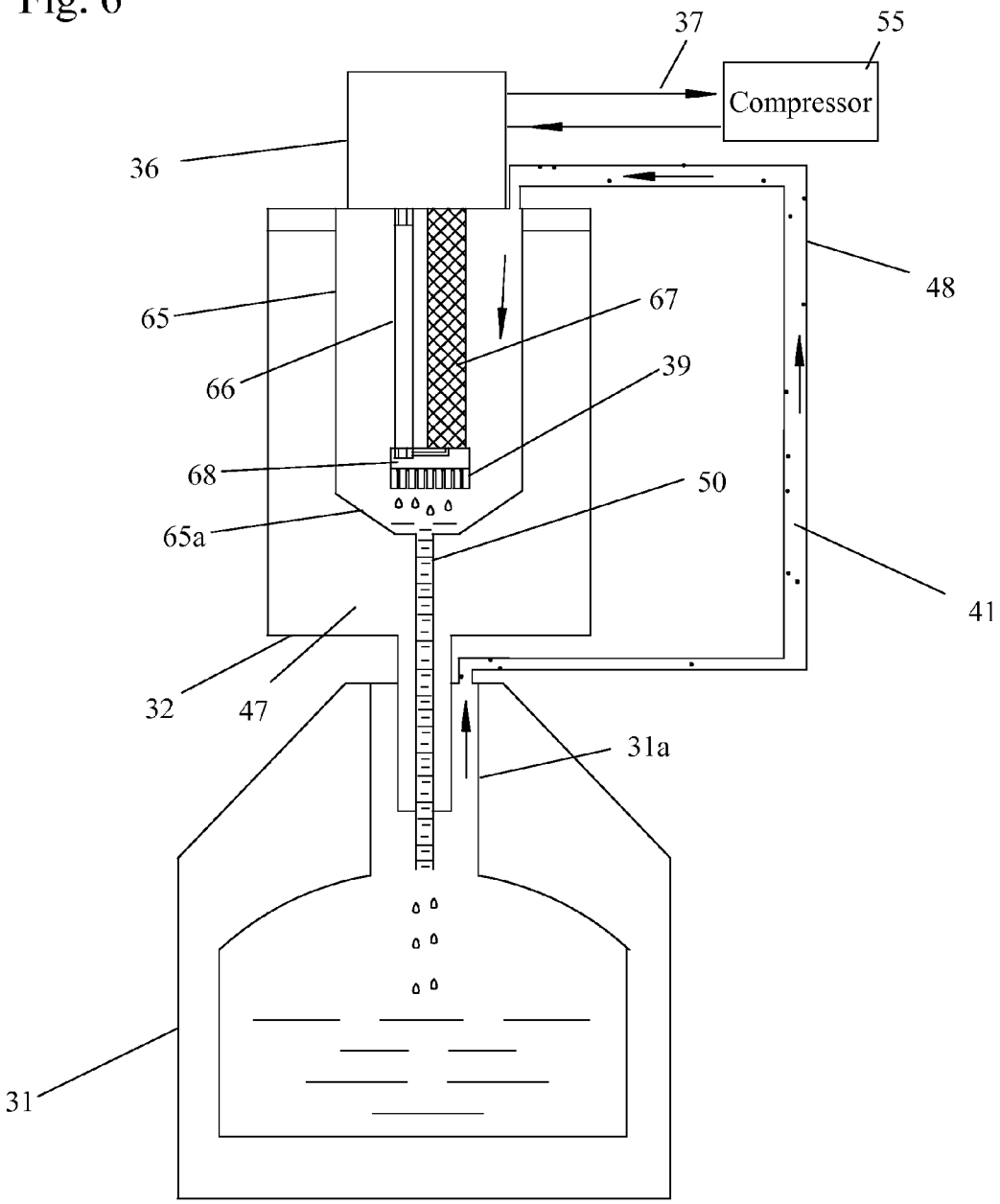
FIG. 6 shows a schematic of the present invention with a reliquifier using single stage pulse tube cryocooler.

FIG. 6 shows a schematic of a single stage pulse tube cryocooler of the present invention. In this embodiment, a portion of the cold head 36 is present within a vacuum insulated sleeve 65 that has an end 65*a* in fluid communication with a liquid transfer tube 50 leading back to the cryostat 31. The parts of the cold head in the vacuum are a regenerator 67, a pulse tube 66, a cooling station 68 and a condenser 39. The condenser 39 is thermally mounted on the cooling station 68. Therefore, the cold head 36 has a hot end outside, and a cold end within, the vacuum insulated sleeve 65. Heat from the cooling station 68 is removed by the pulse tube 66 and the regenerator 67. A compressor 55 is connected to the cold head 36 through high and low pressure lines 37 for powering the cold head.

A leg of the liquid transfer tube 50 inserts into and is in fluid communication with the neck 31*a* of the cryostat 31. A vacuum space 47 is present between the vacuum insulated sleeve 65 and the vacuum housing 32.

Cryogen present within cryostat or dewar 31 boils off due to heat entering the inside of the cryostat 31 from the ambient atmosphere. The vapor 41 of the cryogen flows through a tube 48 connecting the cryostat 31 to the vacuum insulated sleeve 65 including a portion of the cold head 36. As it passes through the cold head, the vapor 41 is precooled by the tubes of regenerator 67 and pulse tube 66 and condensed into liquid on the fins of the condenser 39. From the condenser 39, liquid drips into the bottom end 65*a* of the vacuum insulated sleeve 65 and flows back to the cryostat 31 through the liquid transfer tube 50.

By having a portion of the cold head reside within the vacuum insulated sleeve 65, the cold head 36 is present within the cryogen vapor environment, ensuring more efficient precooling of the vapor for reliquifying.

Figure 7:
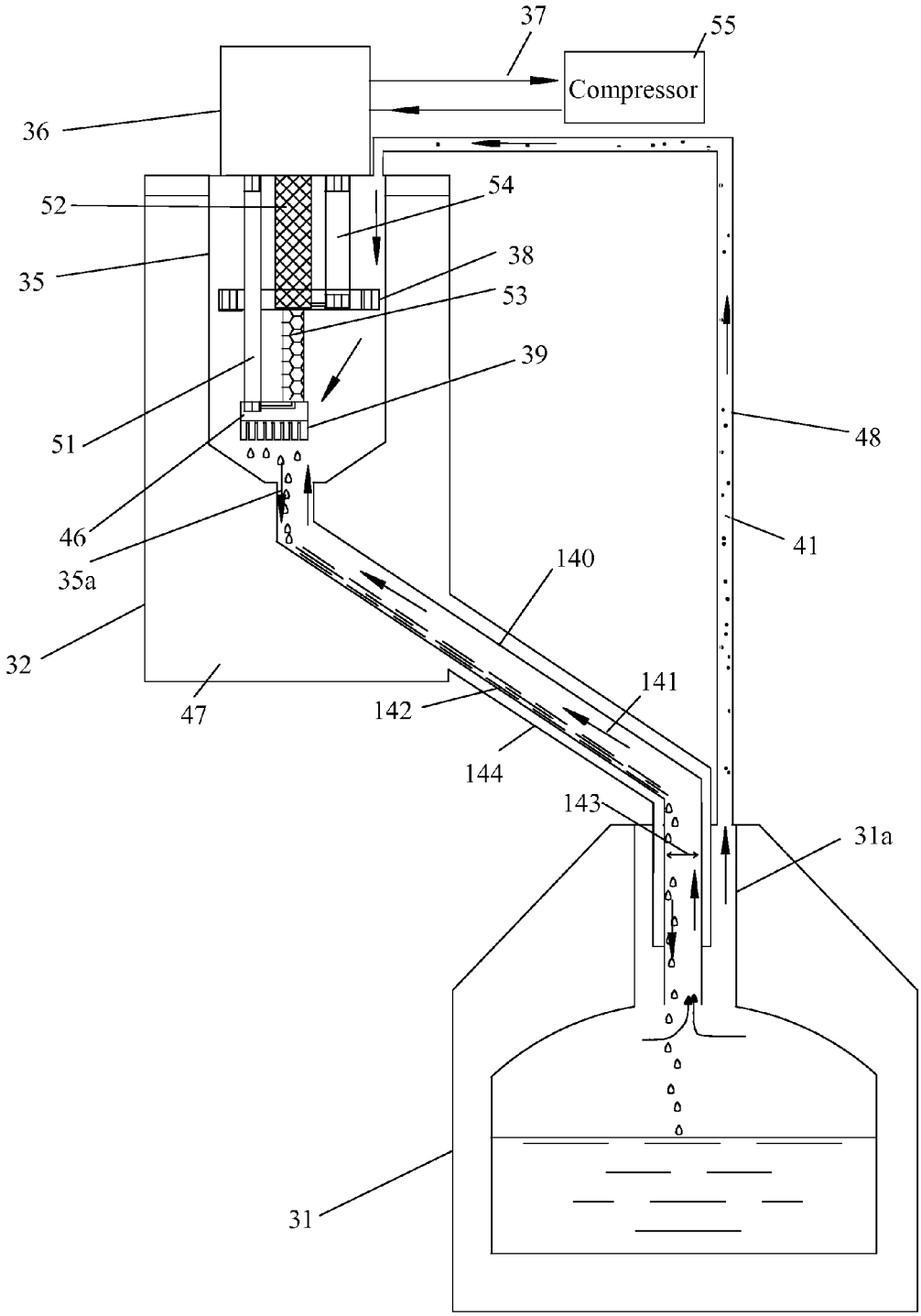
FIG. 7 shows a schematic of an embodiment of the invention which functions as both reliquifier and recondenser.

FIG. 7 shows an embodiment of the invention in which the reliquifier also serves as a recondenser. In this figure, all elements which are the same as those in the embodiment of FIG. 2 have the same reference numerals, and the detailed discussion of these elements will only be discussed herein as necessary for the understanding of this embodiment.

In the previous embodiments, the primary function of the reliquifier of the invention was to turn boiled-off cryogen (helium gas) 41, which is at or near room temperature (i.e. around 300K) back into liquid at ~4.2K. In this embodiment, the invention also acts as a recondender, condensing cold cryogen at ~4.2K into liquid, as well.

In this embodiment, the width 143 of tube 140 is made large enough that the condensed liquid cryogen 142 does not fill the tube. This allows a counter-flow of cold cryogen (helium) 141, collected from the dewar 31, to flow up the tube 140. This cold cryogen is recondensed back into liquid on the condenser, and then flows as liquid 142 back down the tube 140 and into the dewar 31. The tube 140 is preferably vacuum insulated 144.

It is important in this configuration that the tube 140 must run at most level, and preferably downwards, so that liquid 142 cannot be trapped in the tube 140 and form a liquid trap like the "u-bend" in a sink. This would prevent counterflow of gas, and stop the recondensation process.

The reliquifier/recondenser embodiment of FIG. 7 has been found to produce a significantly higher liquefaction capacity for a given cooler size than a pure reliquifier arrangement where the tube is too small to allow counterflow of cold gas—as much as double the capacity.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of recondensing boiled-off cryogen from a cryostat from a gaseous state to a liquid state using a multi-stage cryocooler cold head comprising a hot end and a cold end, at least two cooling stations at the cold end, and a condenser thermally coupled to a lowest stage cooling station at the cold end; a vacuum insulated sleeve with an upper end and a liquid end, surrounding the cold end of the cold head of the cryocooler, the at least one cooling station and the condenser; and a gas trapping tube between the upper end of the sleeve and a gas outlet of the cryostat; a liquid transfer tube with a first end connected to the liquid end of the vacuum insulated sleeve and a second end in fluid communication with the cryostat, a heat transfer ring surrounding the vacuum insulated sleeve adjacent to a cooling station; and a radiation shield connected to the heat transfer ring and surrounding at least a lower portion of the vacuum insulated sleeve and the liquid transfer tube; the method comprising the steps of:

collecting boiled-off cryogen in gaseous state from the cryostat;

conducting the cryogen through the gas trapping tube from the cryostat to the upper end of the sleeve;

precooling the cryogen by passage around the cryocooler cold head;

recondensing the cryogen into a fluid state on the condenser; and passing the recondensed cryogen in fluid state from the condenser within the insulated sleeve through the liquid transfer tube back into the cryostat.

2. The method of claim 1 in which the cooling station adjacent the heat transfer ring is a first stage cooling station.

3. The method of claim 1, wherein the cryocooler has a first stage cooling station and a second stage cooling station, the lowest stage cooling station being the second cooling station.

4. The method of claim 3, wherein the vacuum insulated sleeve is comprised of a first portion surrounding the first stage cooling station and a second portion surrounding the second stage cooling station, the first portion and the second portion of the vacuum insulated sleeve being separated by the heat transfer ring.

5. The method of claim 1, wherein the liquid transfer tube has at least one bend between the first end connected to the liquid end of the vacuum insulated sleeve and the second end in fluid communication with the cryostat.

6. The method of claim 1, wherein the liquid transfer tube is straight between the first end connected to the liquid end of the vacuum insulated sleeve and the second end in fluid communication with the cryostat.

7. The method of claim 1, in which the liquid transfer tube has a width at least large enough to provide a counterflow path for cold gas from the cryostat to the condenser while liquid is flowing through the liquid transfer tube from the condenser to the cryostat, and the liquid transfer tube leads on a downward path from the condenser into the cryostat such that no liquid trap is formed in the tube to block counterflow of gas; the method further comprising the steps of:

conducting cold cryogen gas upward through the liquid transfer tube;

condensing the cold cryogen gas to liquid cryogen on the condenser; and conducting the liquid cryogen to the cryostat downward through the liquid transfer tube.

8. The method of claim 3, further comprising the steps of:

introducing cryogen in a gaseous state from an external gas supply to the upper end of the sleeve; and liquefying the cryogen in a gaseous state from the external gas supply by passing the cryogen around the cryocooler cold head.

* * * * *